US007264043B2

(12) United States Patent
Alinovi et al.

(10) Patent No.: US 7,264,043 B2
(45) Date of Patent: Sep. 4, 2007

(54) CONDENSER FOR VEHICLES AND INTEGRATED RADIATOR-CONDENSER BODY INCLUDING SAID CONDENSER

(75) Inventors: Marco Alinovi, Poirino (IT); Giuseppe Tiziano, Poirino (IT); Davide Perocchio, Poirino (IT)

(73) Assignee: Denso Thermal Systems SpA., Pirino (IT)

( * ) Notice: Subject to any disclaimer, the term of this patent is extended or adjusted under 35 U.S.C. 154(b) by 411 days.

(21) Appl. No.: 10/956,081

(22) Filed: Oct. 4, 2004

(65) Prior Publication Data

US 2005/0126764 A1 Jun. 16, 2005

(30) Foreign Application Priority Data

Oct. 2, 2003 (IT) ..... TO2003A0768

(51) Int. Cl.
*F25B 39/04* (2006.01)

(52) U.S. Cl. ..... 165/119; 165/132; 165/110

(58) Field of Classification Search ..... 165/119, 165/132; 62/509
See application file for complete search history.

(56) References Cited

U.S. PATENT DOCUMENTS 2,128,720 A * 8/1938 Tweedale ..... 285/18
5,946,940 A * 9/1999 Inoue ..... 62/509
6,209,349 B1 * 4/2001 Hu et al. ..... 62/509
6,301,926 B1 * 10/2001 Avequin et al. ..... 62/509
6,494,059 B2 * 12/2002 Yamazaki et al. ..... 62/509
2002/0046571 A1 * 4/2002 Bernini ..... 62/474
2004/0182553 A1 * 9/2004 Seno et al. ..... 165/132

FOREIGN PATENT DOCUMENTS

| | | | |
|---|---|---|---|
| EP | 0 769 666 | A1 | 4/1997 |
| EP | 1521047 | A1 * | 4/2005 |
| FR | 2 820 368 | A1 | 8/2002 |
| JP | 11-270927 | A | 10/1999 |
| JP | 2000-314574 | A | 11/2000 |
| JP | 2001-174103 | A | 6/2001 |

* cited by examiner

*Primary Examiner*—Allen J. Flanigan
(74) *Attorney, Agent, or Firm*—Sughrue Mion Pllc.

(57) ABSTRACT

A condenser (14) for vehicles, comprising:

a pair of mutually parallel distributors (28,30), a plurality of mutually parallel tubes (32) positioned orthogonally to the distributors (28, 30) and with their ends in fluid connection with said distributors (28, 30), in which the tubes are subdivided into a condensation section (62) and into a sub-cooling section (64), a filter body (42) having an inlet (108) in fluid connection with the condensation section (62) and an outlet (110) in fluid connection with the sub-cooling section (64).

6 Claims, 6 Drawing Sheets

CONDENSER FOR VEHICLES AND INTEGRATED RADIATOR-CONDENSER BODY INCLUDING SAID CONDENSER

BACKGROUND OF THE INVENTION

The present invention relates to a condenser for vehicles of the type with condensation section and sub-cooling section and with filter body integrated in the structure of the condenser.

In the most common solutions, condenser with sub-cooling section and with integrated filter body, the filter body extends parallel to a distributor. In solutions of this kind, the fluid connection between the filter body and the distributor is obtained simply by means of two openings formed in the walls in mutual contact of the distributor and of the filter body.

The fluid connection between the filter body and the distributor is much more complex when the filter body has to be positioned parallel to the tubes, i.e. orthogonal relative to the distributor. In this case, it is necessary to provide a junction device with fluid inlet and outlet openings positioned at 90° relative to each other.

SUMMARY OF THE INVENTION

The object of the present invention is to provide a condenser for vehicle with sub-cooling section and with integrated filter body positioned parallel to the tubes and equipped with a junction device for the fluid connection between the filter body and the distributor which is particularly simple and has low cost.

The present invention can be applied to a condenser forming an autonomous constructive unit or to an integrated radiator-condenser assembly in which the radiator and condenser functions are grouped in indivisible fashion in a single constructive unit.

BRIEF DESCRIPTION OF THE DRAWINGS

The present invention shall now be described in detail with reference to the accompanying drawings, provided purely by way of non limiting example, in which.

DETAILED DESCRIPTION OF THE INVENTION

Figure 1:
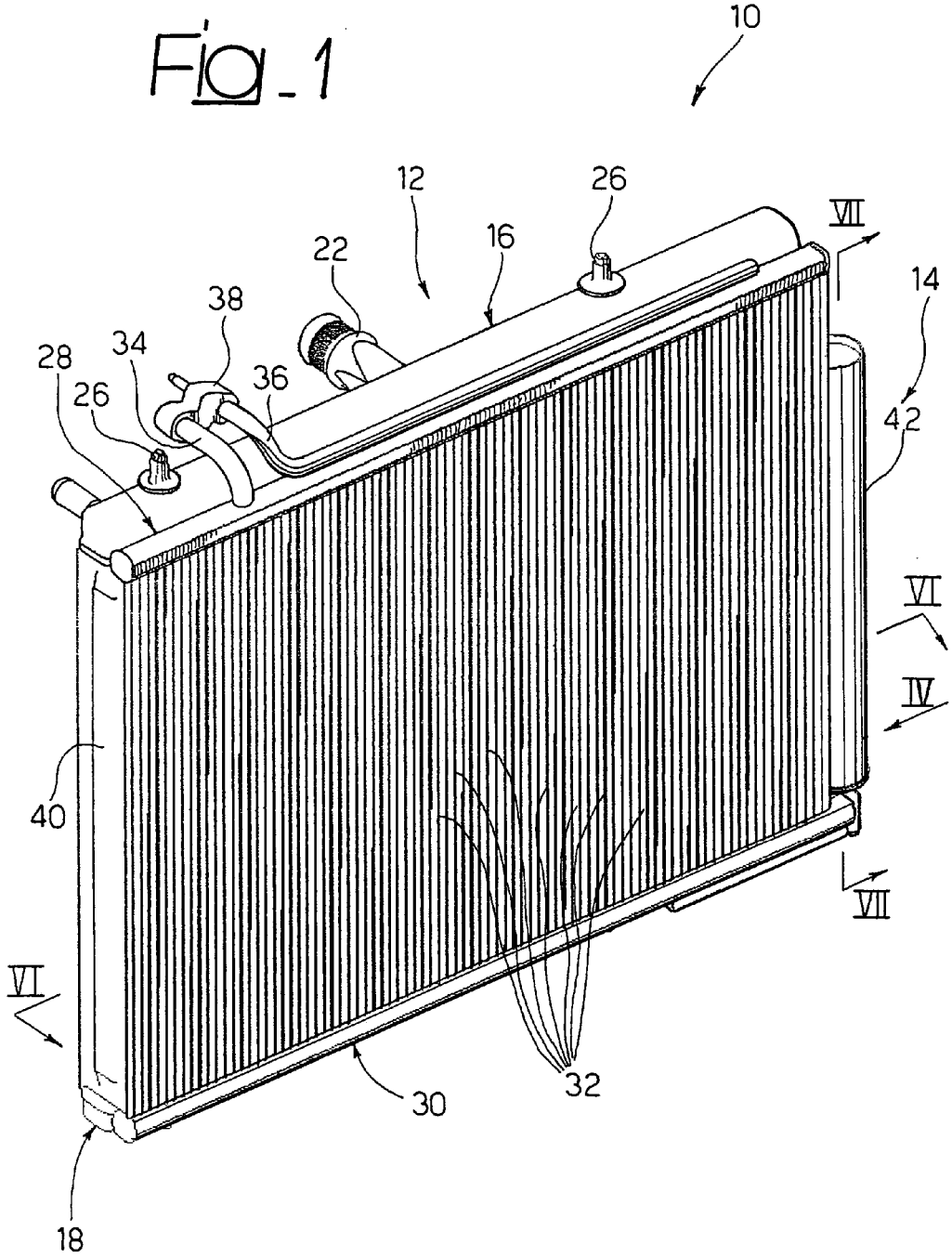
FIG. 1 is a perspective view showing an integrated radiator-condenser assembly according to the present invention seen from the condenser side.
Figure 2:
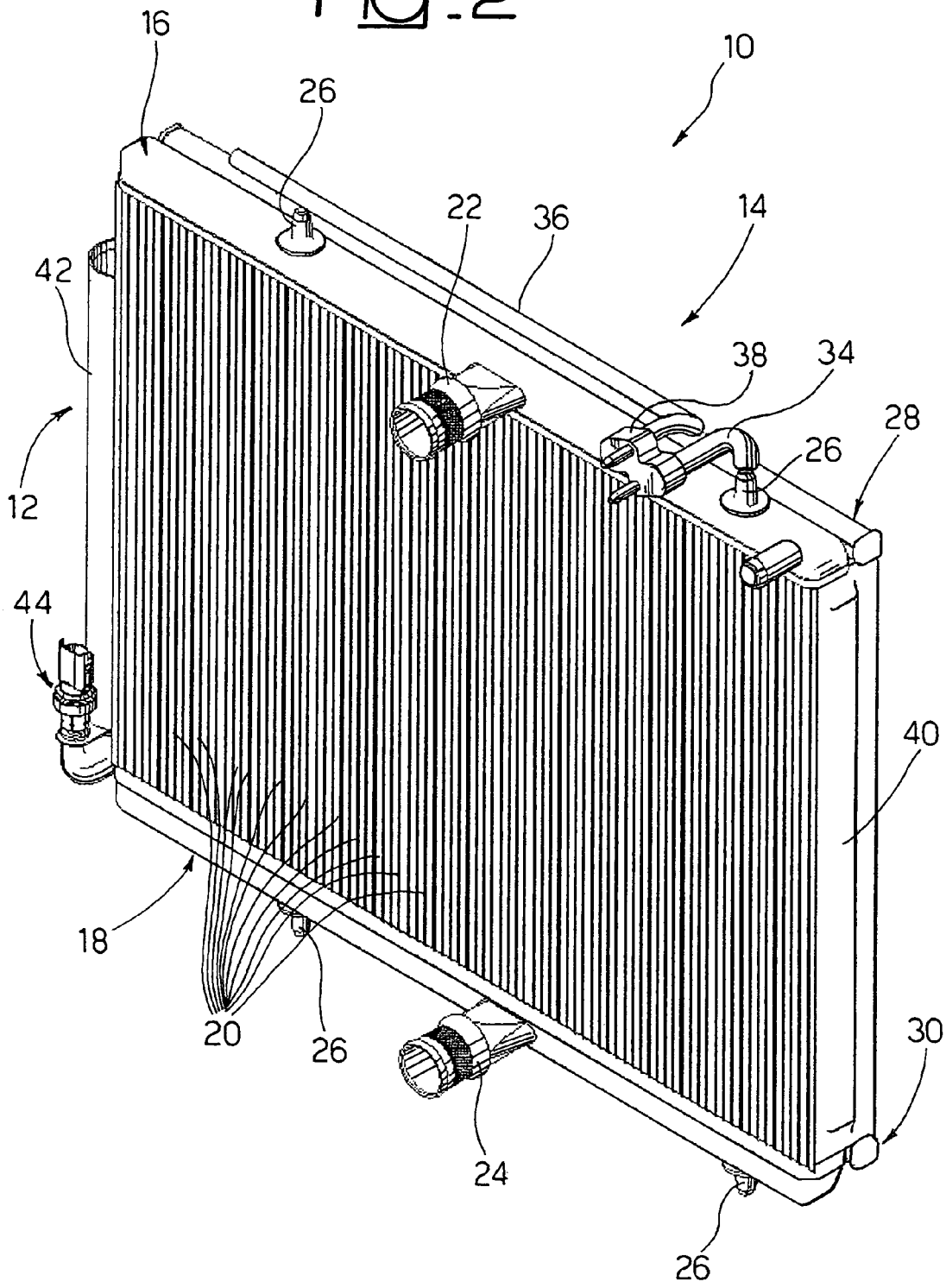
FIG. 2 is a perspective view showing the integrated assembly of FIG. 1, seen from the radiator side.

With reference to FIGS. 1 and 2, the reference 10 designates an integrated radiator-condenser assembly for vehicles. The assembly 10 is formed by a single indivisible constructive unit which serves as a radiator for the engine cooling system and as a condenser for the air conditioning system of a vehicle. The integrated assembly 10 comprises a radiator section 12 and a condenser section 14.

FIGS. 1 and 2 show the integrated radiator-condenser assembly 10 in the position in which it is intended to be mounted on a vehicle. In the remainder of the description, terms that define a spatial orientation, such as upper, lower, horizontal, vertical, etc., refer to the position of the assembly 10 when it is mounted on a vehicle.

With reference to FIG. 2, the radiator section 12 comprises an upper collector tank 16 and a lower collector tank 18 which extend horizontally and parallel relative to each other. The collector tanks 16, 18 are positioned in fluid connection with an array of tubes 20 which extend vertically and through which, in use, circulates a flow of engine cooling fluid. The upper collector tank 16 is provided with a fluid inlet junction 22 and the lower collector tank 18 is provided with a fluid outlet junction 24. The collector tanks 16, 18 are preferably provided with integral vertical pivots 26 for positioning and fastening the body 10 on the vehicles.

With reference to FIG. 1, the condenser section 14 comprises an upper distributor 28 and a lower distributor 30, horizontal and parallel to each other, positioned in fluid connection with a plurality of vertical tubes 32. The tubes 32 of the condenser section 14 and the tubes 20 of the radiator section are flat aluminium tubes. Between the tubes 30, 32 is positioned a plurality of undulated fins (not shown). The tubes 32 of the condenser section 14 are mutually parallel and are fastened at their ends to the distributors 28, 30 which extend orthogonally relative to the tubes 32. The condenser section 14 comprises a fluid inlet conduit 34 and a fluid outlet conduit 36. The conduits 34, 36 are preferably connected to a single junction element 38.

The assembly 10 comprises two lateral plates 40 which extend vertically between the collector tanks and the upper and lower distributors and which serve the purpose of protecting and strengthening the tubes-fins pack.

The condenser section 14 comprises a filter body 42 permanently fastened to the assembly 10. The filter body 42 is constituted by a cylindrical container that extends vertically, i.e. in a direction that is parallel to the tubes 32 and orthogonal to the distributors 28, 30 of the condenser section 14. Conventionally, inside the filter body 42 is housed a filter (not shown) for the flow of cooling fluid of the vehicle air conditioning system. The filter body 42 also contains dehydrating material which can be constituted by granular material contained in a pouch of permeable material housed inside the filter body 42. The inner volume of the filter body 42 also serves as an expansion vessel of the air conditioning system. The filter body 42 is positioned outside the tube-fin pack and it is parallel and adjacent to one of the two lateral plates 40 of the body 10. Moreover, the assembly 10 is preferably provided with a pressure sensor 44 adjacent to the filter body 42 and positioned in such a way as to measure the pressure of the fluid within the condenser section 14.

Figure 3:
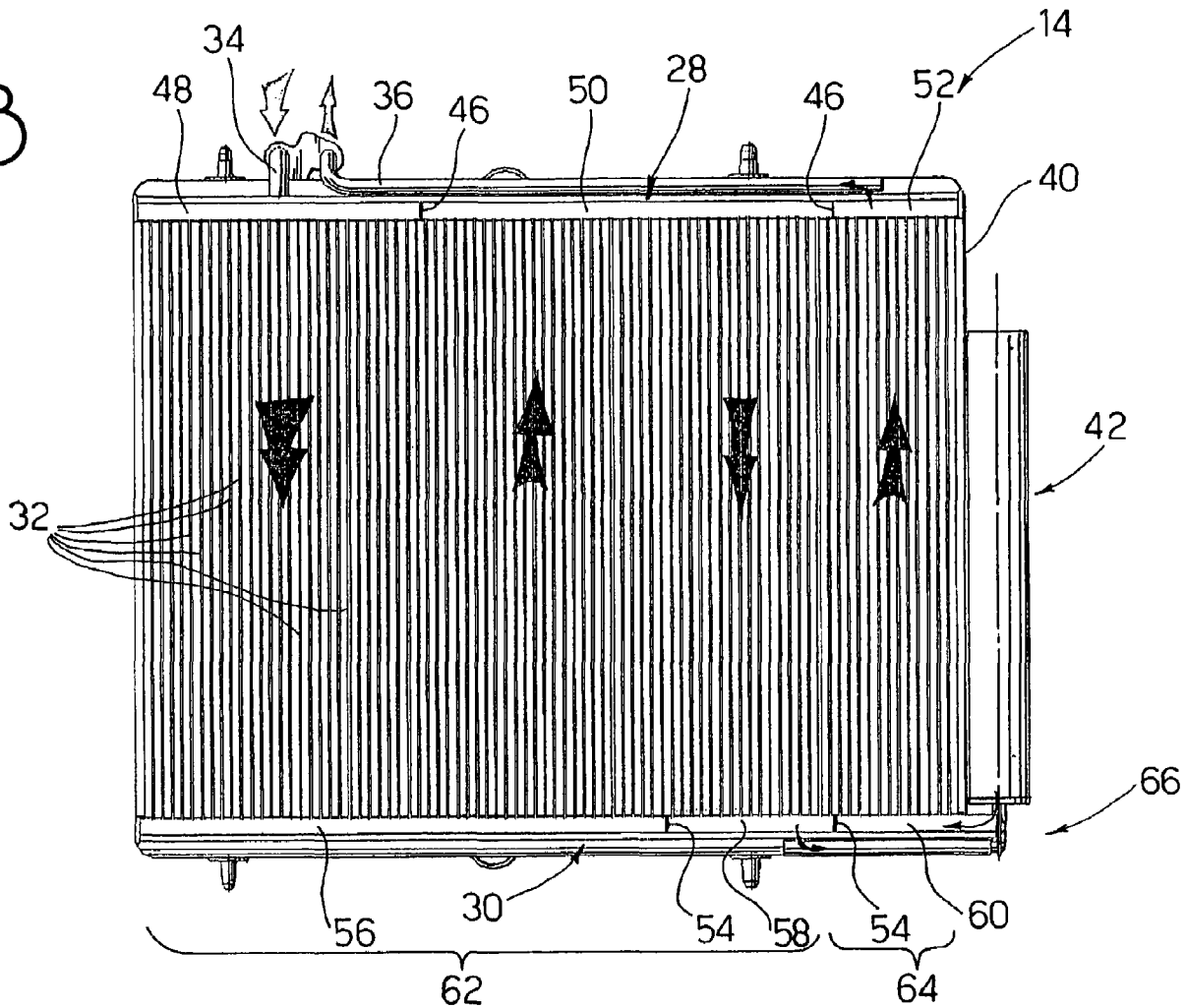
FIG. 3 is a front schematic view showing the circulation of the fluid in the condenser of the assembly illustrated in FIGS. 1 and 2.
Figure 4:
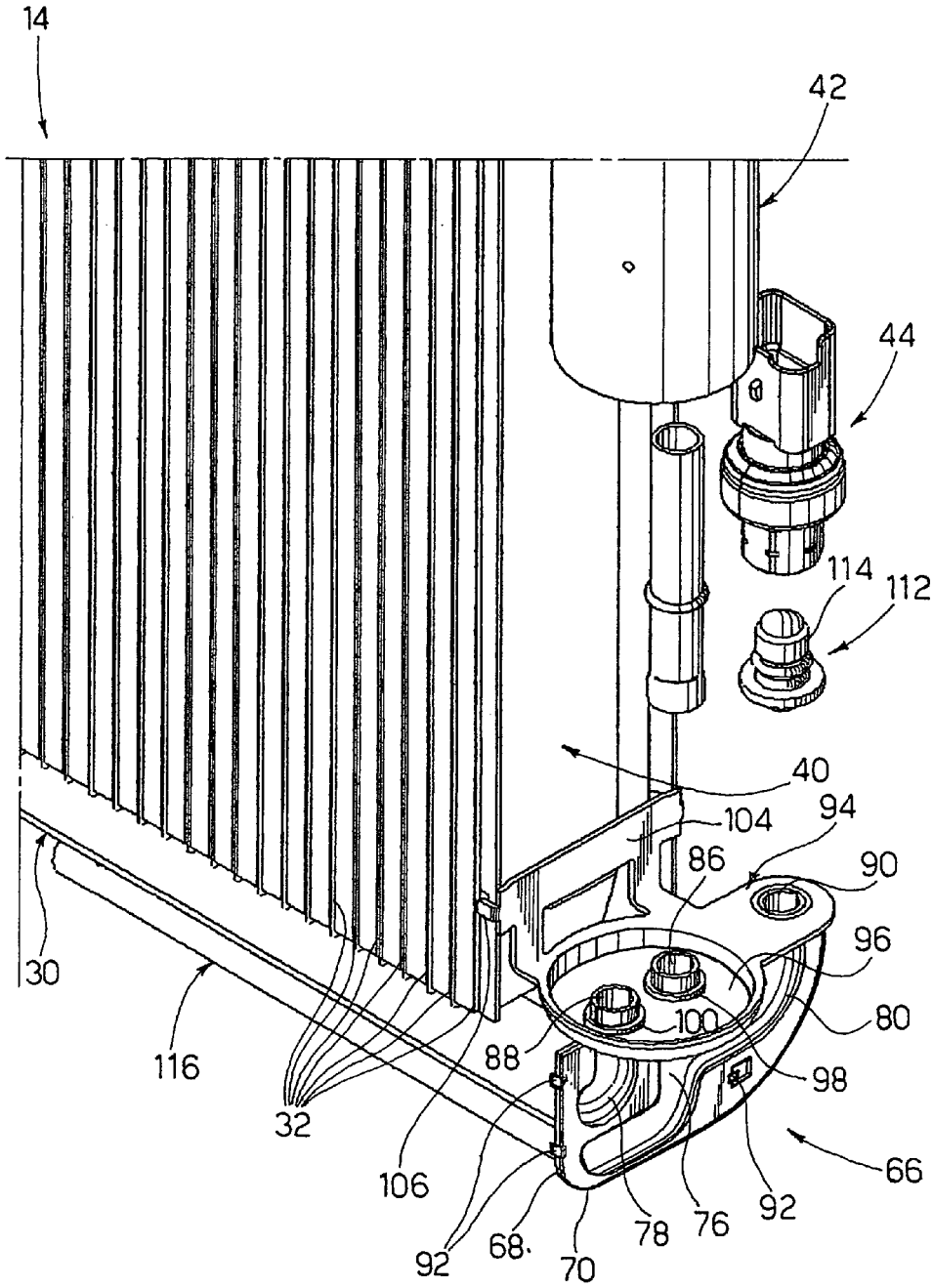
FIG. 4 is a partially exploded, enlarged scale perspective view of the part designated by the arrow IV in FIG. 1.
Figure 5:
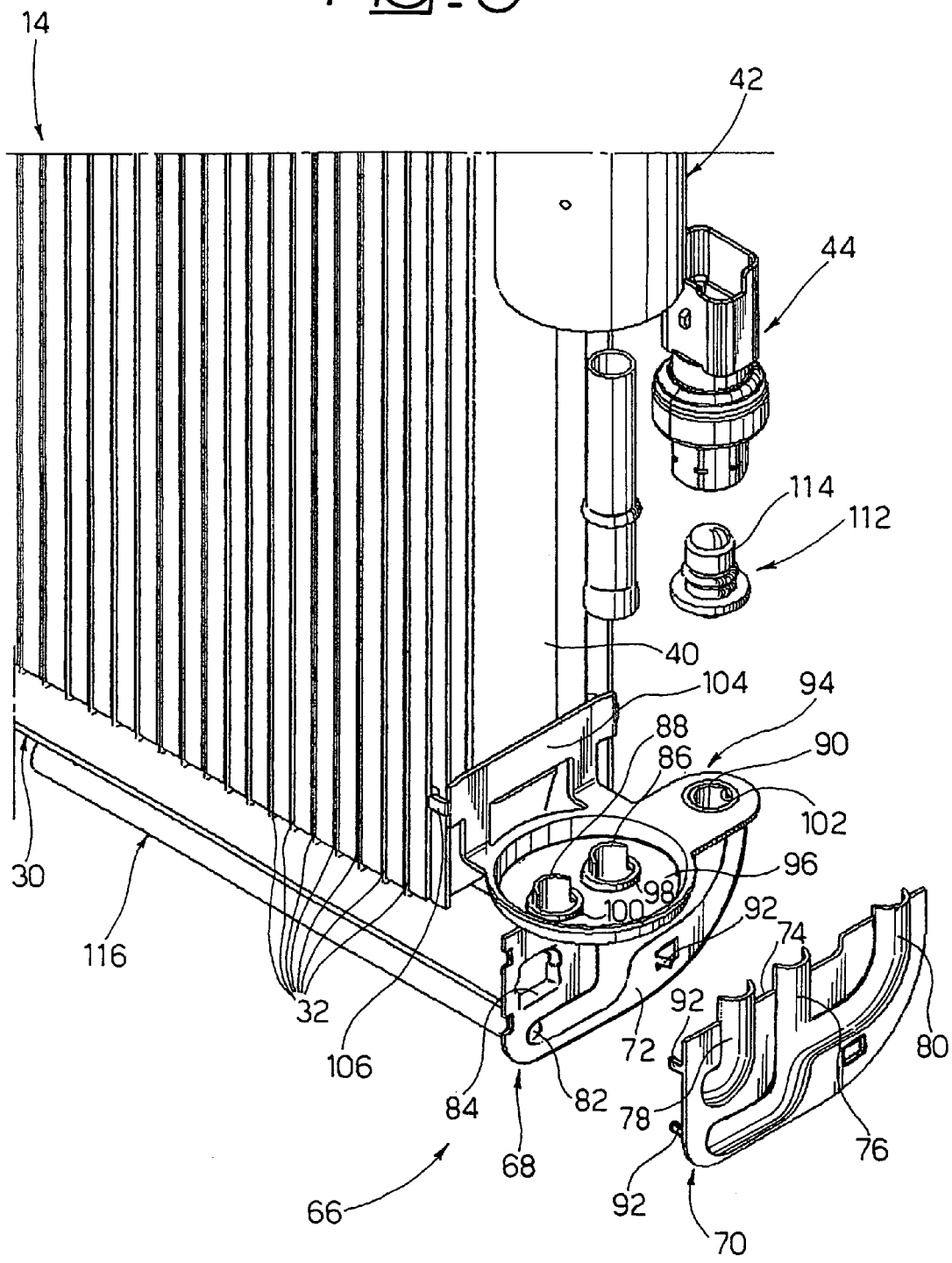
FIG. 5 is a perspective view, similar to FIG. 4 and showing the plates of the junction device in exploded position.

With reference to FIG. 3, the upper distributor 28 is provided with two baffles 46 which subdivide the inner volume of the condenser 28 into three chambers, respectively designated by the references 48, 50 and 52. The lower distributor 30 is provided with two baffles 54 which subdivide the inner volume of the distributor 30 into three chambers designated respectively by the references 56, 68 and 60. The baffles 46, 54 cause the fluid to travel through the tubes 32 in the direction indicated by the arrows. In particular, the fluid enters the chamber 48 and flows downwards in the chamber 56 through a first series of tubes. From the chamber 56 the fluid flows upwards through a second series of tubes and reaches the chamber 50. From the chamber 50 the fluid flows downwards through a third series of tubes and reaches the chamber 58. The fluid exits the chamber 58 and is sent into the filter body 42 in the manner which shall be described below. The fluid then exits the filter body 42 and enters the chamber 60 from which, passing through a fourth series of tubes, reaches the chamber 52 connected to the outlet conduit 36. The tubes that are positioned in fluid communication with the chambers 48, 50 and 50, 58 form a condensation section 62. The tubes positioned in fluid communication with the chambers 52 and 60 define a sub-cooling section 64.

The filter body 42 is positioned in fluid communication with the chambers 58, 60 of the lower distributor 30 by means of a junction device 66 shown in detail in FIGS. 4 through 7. The junction device 66 comprises two aluminium plates plated with brazing alloy 68, 70. The two plates are subjected to a mechanical process of plastic deformation by means of pressing, during which on each plate are formed deformed surfaces which form half of a series of conduits for fluid passage. The two plates 68, 70 have planar union surfaces 72, 74 which are mutually joined and fastened by means of brazing in a furnace. The deformations of the plates 68, 70 have such a shape that, when the two plates 68, 70 are mutually joined along the respective union surfaces 72, 74, the deformed portions of the two plates 68, 70 match each other in such a way as to define at least two conduits, each with an inlet and an outlet. In the preferred embodiment illustrated in the figures, the junction conduit 66 is provided with two main conduits 76, 78 and with an auxiliary conduit 80. Each of the two main conduits 76, 78 has two openings, oriented at 90° relative to each other.

The plate 68 has two openings 82, 84 with outwardly folded edges which form two openings of the main channels 76, 78 oriented in the horizontal direction. The main channels 76, 78 have respective projecting end portions 86, 88 which form two openings of the main channels 76, 78 oriented vertically. The auxiliary channel 80 is formed by a branch of the first main channel 76 and it has an opening 90 oriented in the vertical direction.

The two plates 68, 70 are provided with integral deformable fins 92 which allow to achieve a temporary mutual connection between the two plates 68, 70 by means of seaming. The connection achieved by folding the deformable fins 92 constitutes a preliminary tacking connection which allows to hold the plates 68, 70 together while assembling the various components of the assembly 10. The definitive fastening between the plates 68, 70 takes place by brazing when the integrated assembly is passed in a furnace.

The junction device 66 further comprises a support flange 94 constituted by a plate of aluminium plated with brazing alloy and subjected to a plastic deformation operation by pressing. The support flange 94 has a lowered circular seat 96 provided with two holes 98, 100 with folded edges which receive the ends 86, 88 of the two main conduits 76, 78. The plate 94 is provided with a third hole 102 which receives the end 90 of the auxiliary conduit 80. The support flange 94 is also provided with an anchoring portion 104 with a bearing surface in contact against a portion of the outer surface of the lateral plate 40. The anchoring portion 104 is provided with deformable fins 106 for the preliminary connection by seaming with the lateral plate 40. The anchoring portion 104 is permanently fastened to the lateral plate 40 by brazing the passage of the assembly 10 in the furnace.

Figures 6, 7:
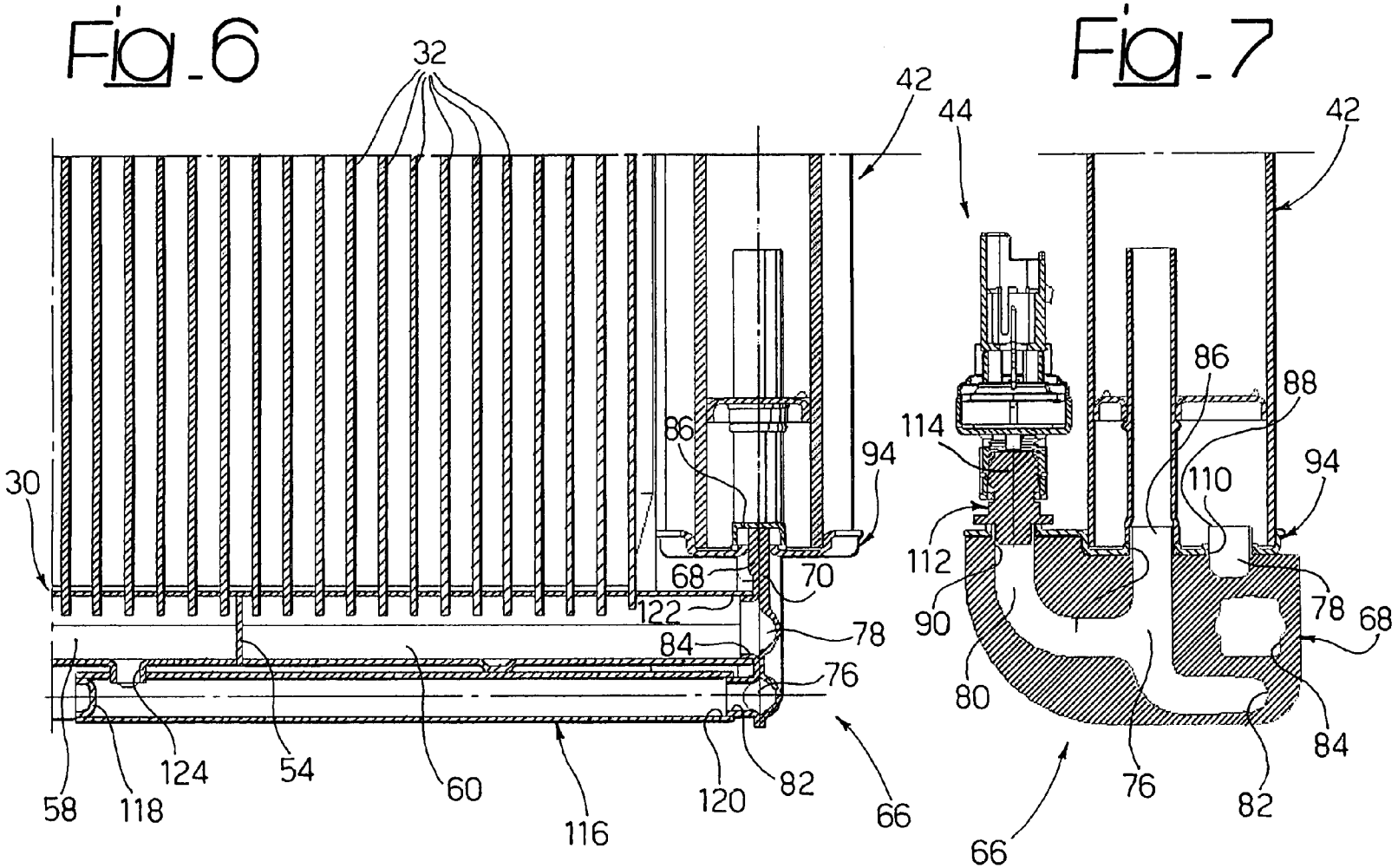
FIGS. 6 and 7 are sections according to the lines VI-VI and VII-VII of FIG. 1.

With reference to FIG. 7, the filter body 42 has an inlet opening 108 and an outlet opening 110 for the fluid, respectively connected to the openings 86, 88 of the junction device 26. The lower portion of the filter body 42 is housed in the lowered seat 96 of the support flange 94. The lower end of the filter body 42 is fastened by brazing along the contact surfaces with the seat 96 of the support flange 94. As shown in FIG. 7, the ends 86, 88 of the conduits 76, 78 are fastened in permanent and fluid-tight fashion in the inlet and outlet openings 108, 110 of the filter body 42 during the same furnace brazing operation. On the opening 90 of the auxiliary conduit 80 is inserted a junction conduit 112 which is fastened in fluid-tight fashion on the support flange 94 by brazing. The junction element 112 has a threaded upper portion 114 whereon is mounted the pressure sensor 44 after the furnace brazing operation.

With reference in particular to FIG. 6, the chamber 58 of the lower distributor 30 is placed in fluid connection with a horizontal tube 116. A first end of the tube 116 is closed by a plug 118. A second end 120 of the tube 116 is fastened by brazing on the folded edge of the opening 82 of the junction device 86.

The chamber 60 of the lower distributor 30 is open at its end oriented towards the junction device 66. The open end of the distributor 30, designated by the reference 122 in FIG. 6, is connected in fluid-tight fashion by brazing on the folded edge of the opening 84 of the junction device 66.

In operation, the heat exchange fluid enters the condenser section 14 in the gaseous state through the conduit 34 and flows through the tubes 32 of the condensation section 62. The fluid that reaches the chamber 58 of the lower distributor 30 is almost totally in the liquid state. From the chamber 58 the fluid exits the condensation section 62 through an opening 124 (FIG. 6) which places the chamber 58 in fluid communication with the tube 116. The fluid flows through the tube 116 and enters the filter body 42 passing through the conduit 76 of the junction device 66.

Inside the filter body 42, the fluid comes in contact with the dehydrating material housed in the filter body 42. The fluid is also filtered and exits the filter body 42 completely in the liquid state. The fluid flows through the conduit 78 of the junction device 76 and enters the chamber 60 of the lower distributor 30. From the chamber 60, the fluid flows upwards through the sub-cooling section 64 and reaches the chamber 52 of the upper distributor 28. From the chamber 52, the sub-cooled fluid enters the outlet conduit 36 connected to the outlet opening of the condenser section 14.

The above description refers to an integrated radiator-condenser assembly. However, the present invention can also be applied to a condenser built as an autonomous constructive unit, independent of the radiator.

Naturally, without altering the principle of the invention, the construction details and the embodiments may be widely varied relative to what is described and illustrated herein, without thereby departing from the scope of the present invention as defined in the appended claims.

What is claimed is:

1. A condenser (14) for vehicles, comprising:

a pair of mutually parallel distributors;

a plurality of mutually parallel tubes positioned orthogonally to the distributors and with their ends in fluid connection with said distributors, in which the tubes are subdivided into a condensation section and into a sub-cooling section;

a filter body having an inlet in fluid connection with the condensation section and an outlet in fluid connection with the sub-cooling section;

wherein the filter body extends parallel to the tubes and is connected to the condensation section and to the sub-cooling section by means of a junction device including two pressed metallic plates mutually fastened by brazing along joining surfaces, the junction device being provided with a first series of openings oriented parallel to the distributor and with a second series of openings oriented parallel to the filter body, wherein the junction device comprises a support flange provided with a seat in which is fastened an end portion of the filter body, said support flange including an integral anchoring portion fastened to a lateral plate of the conductor.

2. Device as claimed in claim 1, wherein the two pressed metallic plates are provided with deformable fins for the preliminary mutual connection by seaming.

3. Condenser as claimed in claim 1, wherein said pressed metallic plates are made of sheet metal, plated with brazing alloy.

4. Condenser as claimed in claim 1, wherein the junction device comprises an auxiliary conduit connected to a pressure sensor.

5. Condenser as claimed in claim 1, wherein the openings of the junction device oriented towards the distributor have respective folded edges fastened in fluid- tight fashion within respective frontal openings.

6. A condenser for vehicles, comprising:

a pair of mutually parallel distributors;

a plurality of mutually parallel tubes positioned orthogonally to the distributors and with their ends in fluid connection with said distributors, in which the tubes are subdivided into a condensation section and into a sub-cooling section;

a filter body extending parallel to the tubes and having an inlet in fluid connection with the condensation section and an outlet in fluid connection with the sub-cooling section;

a junction device connecting the filter body to the condensation section and to the sub-cooling section, the junction device including two pressed metallic plates mutually fastened by brazing along joining surfaces and being provided with a first series of openings oriented parallel to the distributor and with a second series of openings oriented parallel to the filter body, wherein one of the two pressed metallic plates has two apertures therethrough with outwardly folded edges at the apertures which form the first series of openings such that an open end of one of the distributors and an open end of a tube parallel to and in fluid connection with the one of the distributors are respectively fastened to corresponding ones of the folded edges of the first series of openings.

* * * * *